US005186484A

United States Patent [19]

Couderc

[11] Patent Number: 5,186,484

[45] Date of Patent: Feb. 16, 1993

[54] SKI SAFETY BINDING

[75] Inventor: Bernard Couderc, Annecy, France

[73] Assignee: Salomon S.A., Chavanod, France

[21] Appl. No.: 817,353

[22] Filed: Jan. 6, 1992

[30] Foreign Application Priority Data

Jan. 4, 1991 [FR] France ..... 91 00207

[51] Int. Cl.[5] ..... A63C 9/08; A63C 9/22

[52] U.S. Cl. ..... 280/633; 280/611

[58] Field of Search ..... 441/70; 280/623, 626, 280/631, 632, 633, 605, 634, 636, 611, 601

[56] References Cited

U.S. PATENT DOCUMENTS 2,754,526 7/1956 Bridges ..... 280/633
3,733,083 5/1973 Berchtold ..... 280/633
4,524,990 6/1985 Svoboda et al. ..... 280/633
4,813,700 3/1989 Riegler et al. ..... 280/633

*Primary Examiner*—Richard M. Camby
*Attorney, Agent, or Firm*—Pollock, Vande Sande & Priddy

[57] ABSTRACT

Alpine binding designed to hold a boot supported on a ski. The binding comprises a slide track 4 attached to the ski, a body movable along this slide track, and a covering piece 11 which encloses the slide track. Holes 13 provide, on the side of the slide track 4, a cut-out section through which the edge of the slide track 5 emerges inside the orifice 13, so that the screw head is partially supported on the bottom of a recess 15 located in the upper portion of the orifice 13 and partially on the upper surface of an edge 9, 10 of the slide track 4.

4 Claims, 1 Drawing Sheet

SKI SAFETY BINDING

FIELD OF THE INVENTION

The invention relates to an alpine ski binding designed to hold the end of a boot supported on a ski. More specifically, the invention concerns means allowing assembly of a binding on a ski, in particular a binding whose longitudinal position is adjustable.

BACKGROUND OF THE INVENTION

In general, a boot is secured on a ski by a front binding and a rear binding. To allow the adaptation of these bindings to the length of the sole of the boot, the rear binding is mounted so as to slide longitudinally along a slide track assembled to the ski. A bolt, or any other locking means, allows a well-defined longitudinal position to be imparted to the body of the binding. From this position during skiing, the body of the binding can be pushed back against the elastic return force of a spring. This backward motion occurs, in particular, when the ski is flexed.

The slide track is assembled on the ski using screws. Most often, during mounting, these screws are tightened by electric or pneumatic screw drivers equipped with a jaw-coupling device which disengages the blade of the screw driver when the screw exhibits resistance to rotation greater than a pre-adjusted moment of forces. Generally, this resistance is reached when the threaded part of the screw reaches a sufficient level of attachment inside the ski.

However, it may occur that the screw does not exhibit sufficient resistance to case the disengagement of the screw driver, in particular given the inertia of the moving part. In this case, the screw turns loosely in its hole while tearing away ski material, which adheres to this threaded portion. A special operation then becomes necessary to repair the housing and allow a new screw to be screwed in place.

This difficulty becomes particularly troublesome when the screw holds the slide track in place by means of a plastic covering which encloses the slide track. In this covering, a hole is provided to house the screw head.

For this device, the friction between the screw head and the hole in the plastic covering is not enough to sufficiently slow the screw at the end of the screwing operation and to cause the screw driver to disengage. Accordingly, at the end of the screwing operation, the hole in the covering piece does not exhibit sufficient resistance to the screw head to stop its rotation. The screw head continues to pivot, but, since it cannot continue its descending motion, the ski material is torn away and rises along its threading.

There are other mounting device which use a clamp, or auxiliary piece. The screw head then rests on a harder surface, which stops its rotation more effectively. However, this device has the disadvantage of requiring an additional part, i.e., the clamp, thus raising the cost of the binding.

SUMMARY OF THE INVENTION

One of the objects of the invention is to propose a ski safety binding for which the mounting screws are effectively slowed during the screwing operation, without requiring an additional part to ensure this slowing action.

Another object of the invention is to propose a binding for which the attachment of the screws in the ski is improved.

Other objects and advantages of the invention will emerge during the following discussion provided for informational, non-restrictive purposes.

The rear alpine ski safety binding comprises:

- a slide track attached to the ski,
- a body which is longitudinally movable along the slide track, and
- a covering piece which encloses the slide track by closing over its edges, at least over a portion of its length, this covering piece having orifices each of which houses an assembly screw arranged so that the screws hold the slide track in place while being supported on the covering piece and each orifice having a recess in which the screw head is lodged. It is characterized by the fact that the bottom of the recess in the orifice is located at the level of the upper surface of the edge of the slide track in the area of this orifice and that the bottom of the recess has a cut-out section located on the slide of the slide track through which the edge of the slide track 5 emerges inside the orifice 13, so that, in the screwed position, the screw head is supported partially on the bottom of the recess and partially on the edge of the slide track.

BRIEF DESCRIPTION OF THE DRAWINGS

In order that the invention may be more clearly understood, a description of an embodiment thereof will now be given by way of example, with reference to the attached drawings.

FIG. 4 is a schematic view similar to FIG. 3 showing an alternative embodiment of the invention.

DETAILED DESCRIPTION

Figure 1:
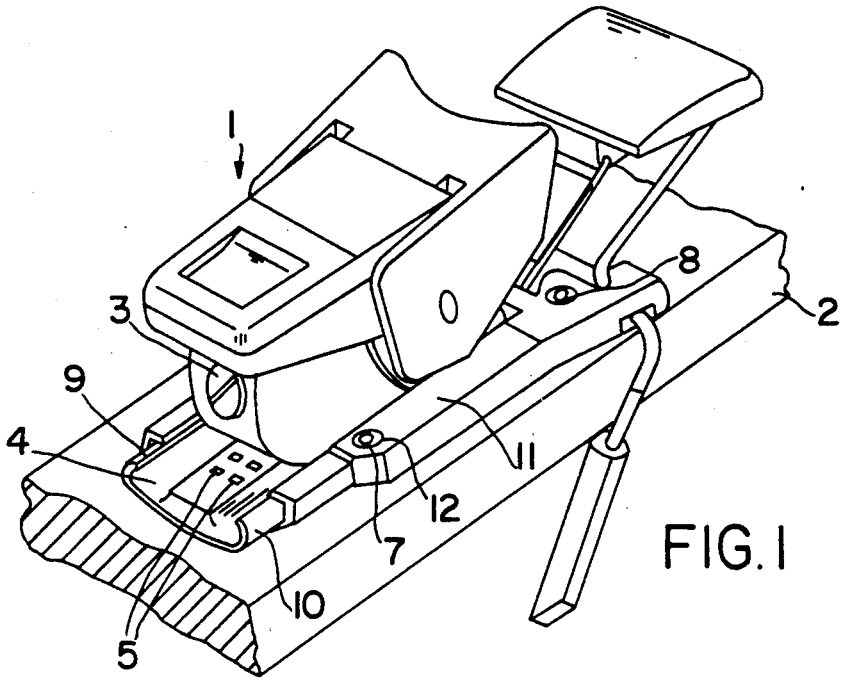
FIG. 1 is a perspective view of a rear binding mounted on a portion of a ski.
Figure 2:
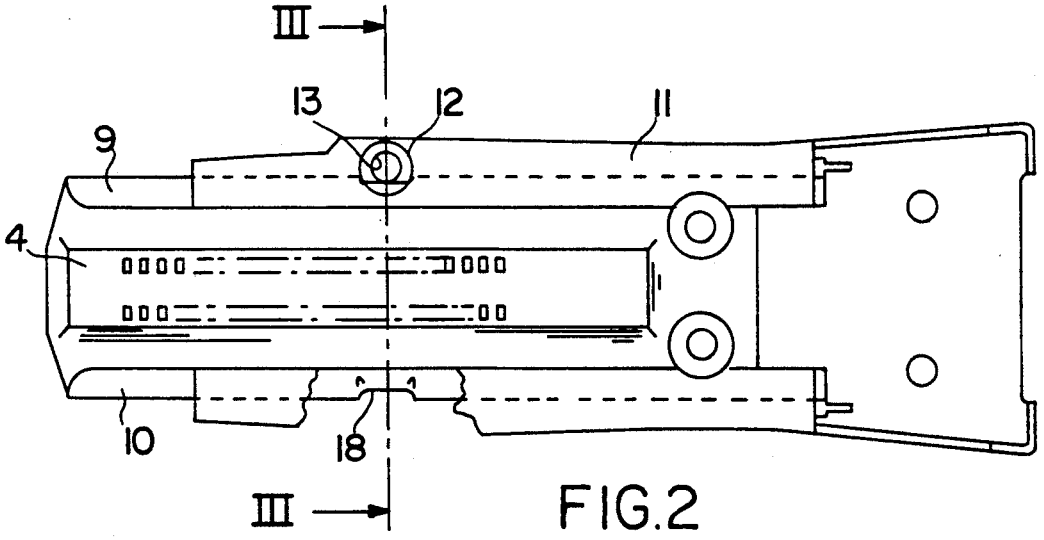
FIG. 2 is a top view of the slide track in FIG. 1.
Figure 3:
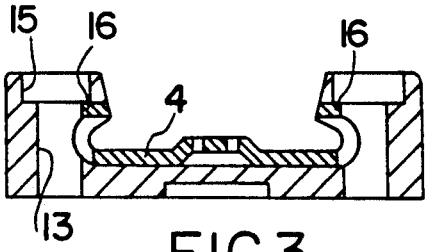
FIG. 3 is a cross-section along 3—3 in FIG. 2.

FIG. 1 represents a binding 1 mounted on a ski, diagramed by a portion of a ski 2. In a conventional manner, the binding 1 comprises a body 3, which is mounted so as to slide along a slide track 4. This body may be put in place in different longitudinal positions along the slide track and immobilized using a device such as a bolt (not shown in FIG. 1), whose teeth are engaged in notches 5, in the slide track 4. From this position, the body may be moved backward against the elastic return force of springs, widely termed return springs. This arrangement is familiar to the specialist.

The slide 4 track is assembled to the ski 2 using screws. In FIG. 1, a rear screw 7 and a front screw 8 are shown.

To facilitate mounting and allow, in addition, the free sliding action of the body 3 along the slide track 4, the rear screws 7 are located to the outside of the curved edges 9 and 10 of the slide track. As in conventional practice, a covering piece 11 encloses the slide track over a portion of its length and surrounds the two edges 9 and 10. The screws 7 pass completely through the lateral edges of the covering piece 11 in the area of the orifices 13, and the screw head is supported on the bottom of a recess 15, located in the upper part of the orifice.

According to the invention, each orifice 13 and its upper recess 15 has, in the area of the edges of the slide-track, a cut-out section 16 through which the slide track itself penetrates inside the orifice 13 and the recess 15. In addition, the upper surface of the edge 9 or 10 of the slide track reaches substantially the level of the bottom of the recess 15, so that the seating surface supporting the screw head is constituted partially by the bottom of the recess 15 and partially by the upper surface of the edge 9 or 10.

Each edge 9 or 10 preferably has, at the level of an orifice 13 in the covering piece 11, an indentation 18 in which the threaded portion of the screw is partially lodged.

In this way, at the end of the screwing operation, the screw head is supported partially on the bottom of the recess 15 and partially on the upper surface of the edge 9 or 10 of the slide track 4.

The edge of the slide track forms a rigid seating surface for the screw head, which holds and slows the screw effectively at the end of the screwing operation. Accordingly, the screw head exhibits increased resistance at the end of its rotation. The screw thus causes the disengagement of the screw driver without allowing the threaded portion of the screw to exert excessive stresses on the inner ski material.

Thus, position maintenance of the screw in the ski is improved, since the screw does not exert excessive stress on the ski material leading to the tearing away of the ski material stressed by the threaded portion of the screw.

According to a preferred embodiment, the area of the edge 9 or 10 of the slide track adjacent the indentation 18 which partially carries the screw head is raised in relation to the rest of the edge so as to form a distinctly elevated zone.

Furthermore, according to another preferred embodiment, as shown in FIG. 4, in the absence of screws, the bottom of the recess 15 is spaced in relation to the area of the edge 9 or 10 of the slide track on which the screw head is supported. This elevation takes into account the crushing of the covering piece, which is generally made of plastic, when screws are used, because of the compression exerted by the screw on the covering piece 11 at the orifice 13. The screw is thus supported uniformly around the entire periphery of its head.

Of course, the invention is applicable to slide tracks equipping certain front bindings, in particular rental bindings whose longitudinal position can be adjusted to match the length of the boot.

What is claimed is:

1. Alpine ski safety binding designed to hold a boot supported on a ski and comprising a slide track (5) attached to said ski, said slide track having a pair of edges body (3) longitudinally movable along said slide track (5), and a covering piece (11) which encloses said slide track (5) by closing over said edges (9,10), at least over a portion of the length, of said slide track said covering piece (11) having orifices (13) each of which houses an assembly screw having a screw head, said assembly screw being arranged so that the screw holds said slide track (5) in place while being supported on said covering piece (11), each said orifice (13) having a recess (15) in which said screw head is lodged and a bottom on which said screw head is supported, wherein said bottom of said recess (15) of said orifice is located at the level of the upper surface of said edge (9, 10) of said slide track (5) in the area of said orifice and wherein said orifice (13) has, on the side of said edge (9, 10) of said slide track, a cut-out section (16) through which the upper edge of said slide tracks penetrates said orifice (13) so that, in the screwed position, said screw head is supported partially on the bottom of said recess and partially on the edge of said slide track.

2. Binding according to claim 1, wherein, in the area of said orifice, said slide track has an indented cut-out section in which the threaded portion of said screw is partially lodged.

3. Binding according to claim 1, wherein said upper surface of the edge of said slide track is raised in the area which partially supports said screw head.

4. Binding according to claim 1, wherein, in the absence of said assembly screws, the bottom of said covering recess is higher than the upper surface of the edge of said slide track.

* * * * *